US006142055A

United States Patent [19]

Borgwarth et al.

[11] Patent Number: 6,142,055

[45] Date of Patent: Nov. 7, 2000

[54] MATRIX GUN SYSTEM

[75] Inventors: Dennis Wolfgang Borgwarth, Anoka; Bradley James Breeggemann, Maple Grove, both of Minn.

[73] Assignee: United Defense, L.P., Arlington, Va.

[21] Appl. No.: 09/098,840

[22] Filed: Jun. 17, 1998

[51] Int. Cl.[7] ..... F41F 3/077

[52] U.S. Cl. ..... 89/1.817; 89/44.02; 89/127; 89/1.81; 89/1.804; 89/1.802; 89/1.814

[58] Field of Search ..... 89/1.81, 1.813, 89/1.814, 1.816, 1.817, 1.818, 126, 127, 1.811, 1.41, 44.02

[56] References Cited

U.S. PATENT DOCUMENTS

| | | | |
|---|---|---|---|
| 2,470,489 | 5/1949 | Hopkins | 89/1.818 |
| 3,410,172 | 11/1968 | Allan | 89/1.804 |
| 3,754,497 | 8/1973 | Rusbach | 89/1.814 |
| 3,894,473 | 7/1975 | Marest et al. | 89/44.01 |
| 4,222,306 | 9/1980 | Maury . | |
| 4,671,163 | 6/1987 | Erikson | 89/1.81 |
| 4,895,061 | 1/1990 | Baricos et al. | 89/1.814 |
| 5,400,690 | 3/1995 | Meili et al. | 89/1.816 |
| 5,491,917 | 2/1996 | Dilhan et al. | 89/44.02 |
| 5,661,254 | 8/1997 | Steuer et al. | 89/1.815 |

FOREIGN PATENT DOCUMENTS

| | | | |
|---|---|---|---|
| 67399 | 7/1948 | Denmark | 89/44.01 |
| 1040577 | 10/1953 | France | 89/44.01 |
| 2518737 | 6/1983 | France | 89/1.816 |
| 737789 | 7/1943 | Germany | 89/44.01 |
| 1180277 | 10/1964 | Germany | 89/1.816 |
| 3940583 | 6/1991 | Germany | 89/1.81 |
| 2161908 | 1/1986 | United Kingdom | 89/1.41 |

*Primary Examiner*—Stephen M. Johnson
*Attorney, Agent, or Firm*—Ronald C. Kamp

[57] ABSTRACT

The invention provides a method and apparatus for firing a guided projectile. The invention provides a matrix of one time shot gun systems. Each one time shot gun system has a one time shot barrel, a one time shot recoil system, a propelling charge, breakable seal, and a guided projectile which is stored in and from the barrel. The one time shot system provides an inexpensive firing system, which eliminates single points of failure that exist in conventional gun systems.

6 Claims, 2 Drawing Sheets

MATRIX GUN SYSTEM

BACKGROUND OF THE INVENTION

The present invention relates generally to large gun systems.

Conventional indirect fire gun systems fire "dumb bullets" where the bullets follow a trajectory based on gun muzzle velocity and the direction the gun barrel is pointed. As with all conventional gun systems shooting dumb bullets, it's systems effectiveness, defined by its range and accuracy and rate of fire, are to a great extent limited to what the gun barrel and gun pointing system can provide. Since bullets of these larger gun systems can weigh 70 lb. and more, are over 4 inches in diameter, and often stand more that 4 feet tall, conventional gun systems also require complicated loading systems that expose people to the dangers associated with loading and handling these munitions. An additional problem of these larger gun systems is that all of the bullets need to be fired out of a single barrel, thereby creating a single point failure possibility of the entire gun systems. Even when the gun system is properly operating, simple physics involved with gun barrel heating and the related loss of mechanical strength of the material at too high of a temperature, often is the limiting factor in gun system rate of fire, one of the critical performance parameters of the gun.

Currently there are gun launched guided munitions, so called "smart bullets" being developed that, much like missiles that have been used for years, once they are launched from the gun they are actively guided to a preprogrammed target. Many are also being fitted with rocket motors that light off at a preset time interval once leaving the gun, thereby further increasing the range of these munitions. Properly designed, these rocket motors require less muzzle velocity, and less internal gun pressure, to achieve the desired range. These smart bullets achieve their longest range when fired at or near vertical position of the gun barrel. A big problem that has been identified by the gun community is that these guided projectiles have a limited shelf life once they leave the environmental protection of their shipping container. In the container the shelf life of the guided rounds can approach 10+ years however out of the container the shelf life is estimated at about 1 year.

Current military battle threats are defeated one of two ways: missiles or indirect fire guns lobbing in munitions at a target. Missiles are typically very expensive, $500,000 and up per missile is not unrealistic, and have ranges of up to hundreds of miles. These missiles are typically used on far out targets, and when guided are very accurate. Indirect fire guns usually have ranges limited to 20 miles or less and usually cost a couple of thousand dollars per round. They are also typically not very accurate and thus required a large amount of rounds to defeat the target. For threats that are at 20 to 100 miles the only current option is to fire a very expensive missile. It is desirable to be able to defeat a target 20 to 100 miles out with something less expensive than missiles. It is also desirable to be more accurate at hitting targets in the gun range thus requiring less munitions, and thus less overall cost, to defeat the close target. It is also more desirable to reduce manpower requirements of the gun and loading system while increasing the overall reliability.

SUMMARY OF THE INVENTION

It is an object of the invention to provide a gun system that has limited moving parts and that can be operated autonomously.

It is another object of the invention to provide a gun system, where the projectiles are less expensive than a conventional missile.

The invention provides a matrix gun system that uses guided projectiles stored in a disposable barrel, which houses the guided projectile, a propelling charge, and a recoil system.

This invention addresses the design of a smart bullet gun launching system that overcomes the well understood problems and issues associated with conventional gun launching systems shooting these bullets, while at the same time addressing the need for a low cost, low manning, high reliability gun system. This invention also allows for autonomous and/or remote operation of the gun system.

DESCRIPTION OF THE PREFERRED EMBODIMENTS

Figure 1:
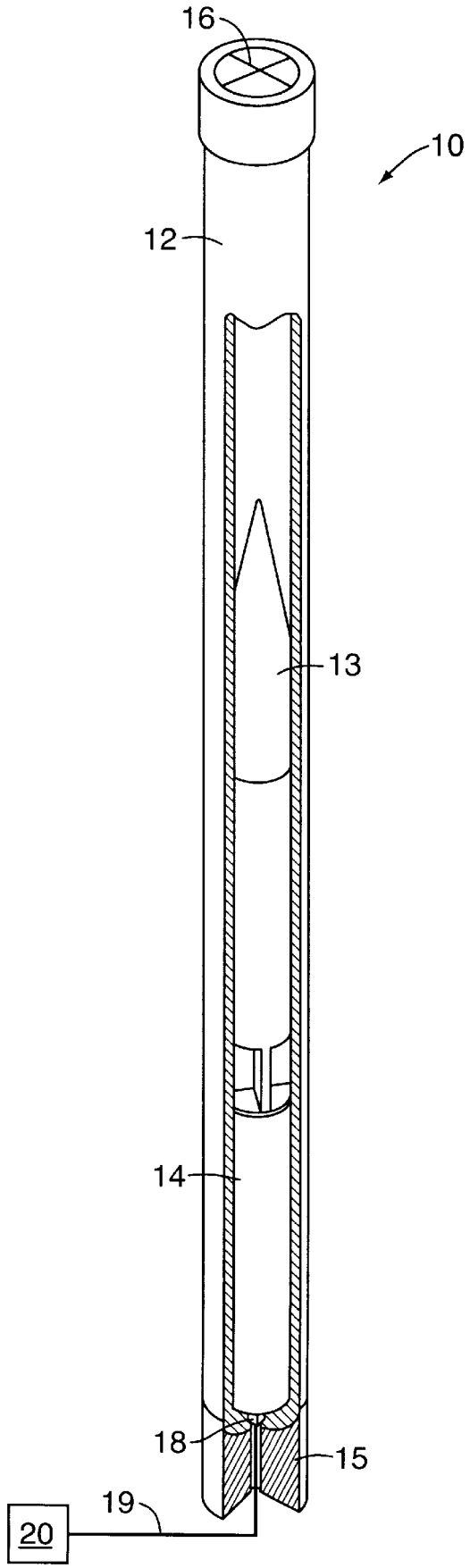
FIG. 1 is a cut away perspective view of a single cell of preferred embodiment of the invention.

FIG. 1 is a cut away perspective view of a single cell 10 of a matrix gun. The cell comprises a barrel 12, a projectile 13, a propelling charge 14, a recoil system 15, and a frangible closure 16.

In the preferred embodiment, the barrel 12 is a steel lined composite overwrap pressure vessel, which is designed to contain the launching pressures required for the ordnance design, and has a bore of 5 inch (12.7 cm) and a length of 310 inches (7.9 m). The barrel 12 is in the form of a cylinder with a first end and a second end, with the first end being a closed end. The projectile 13 is a guided projectile, which can be launched in a vertical direction, and then be turned towards an intended target. The guided projectile 13 has an internal propulsion system, which is able to change the direction of the guided projectile 13 towards a target. Such guided projectiles 13 can be radio controlled, or can have an on board computer which is programmed with the location of the target, or the projectile may be able to detect and seek a target, or have other means for controlling the internal propulsion system to direct the projectile towards a target.

Below the projectile 13 between the projectile 13 and the first end of the barrel 12 is the propelling charge 14. As shown, the propelling charge 14 is outside of (or external to) the projectile 13. In the preferred embodiment, the propelling charge 14 has a propellant volume of 1150 cubic inches (11,845 $cm^3$). A recoil system 15 is placed around the first end of the barrel 12. In the preferred embodiment the recoil system 15 is a collapsible foam which is not reusable. The recoil system 15 is in a cylindrical shape, with a diameter approximately equal to the outer diameter of the barrel 12 and with a length of 20 inches (50.8 cm). A frangible closure 16, such as a plastic sheet is placed across the opening at the second end of the barrel 12, to seal the barrel 12 and protect the projectile 13 and propelling charge 14 from the elements. An ignition system 18, which utilizes one of a multitude of available ignition methods such as electrical, percussion, or laser ignition is placed adjacent to the propelling charge 14. An electrical wire 19 is placed between the ignition system 18 and a control system 20.

The assembly begins at an ordnance depot with a one time use, recoil system 15 being attached to the barrel 12. The propelling charge 14 is then inserted into the barrel 12. The guided projectile 13 is then inserted into the barrel 12. Once inside, the interior of the barrel 12 is filled with a preservative gas to ensure longest shelf life, typically dry air. The air tight, frangible closure 16 is then placed into the open end of the barrel 12 and sealed to the barrel 12. The frangible closure 16 creates an air tight seal, so that the barrel 12 becomes an air tight environment for storage and transportation of the guided projectile 13. The ignition system 18 is then inserted into the barrel 12. This completes the assembly of a single cell 10.

Figure 2:
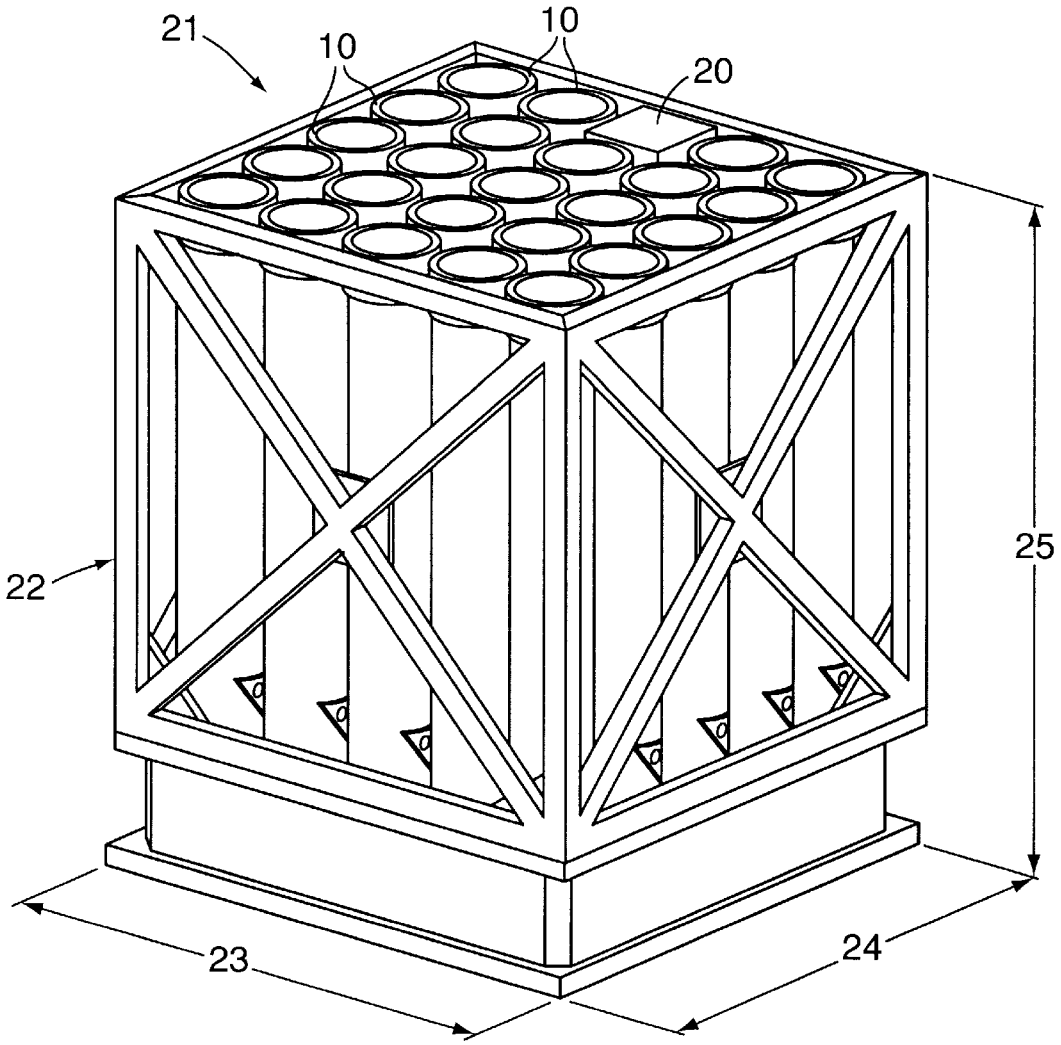
FIG. 2 is a perspective view of a plurality of cells forming the preferred embodiment of the invention.

FIG. 2 shows a plurality of cells 10 in a preferred embodiment of a matrix configuration 21. In the preferred embodiment the cells 10 are placed in a box shaped container 22 that has a length 23 of 80 inches 203 cm), a width 24 of 80 inches (203 cm) and a height 25 of 240 inches (610 cm). 24 cells 10 may be packed in the container 22.

In operation, the matrix configuration 21 is placed on board of a ship or placed on land. Electrical wires 19 (FIG. 1) pass from the ignition systems 18 of the individual cells 10 to a single control system 20, which also provides power electronics. The control system 20 is the control center of the entire matrix. The control system 20 can receive firing commands from a remote site and sends signals through the electrical wires 19 to the ignition systems 18 of individual cells 10, to cause the propelling charge 14 to ignite, firing the projectiles 13. The projectiles 13 may be either fired sequentially or more than one at a time. The recoil from the propellant 14 accelerating the projectile 13 is absorbed by the recoil system 15, where in this embodiment the foam is inelastically compressed. The projectile 13 breaks the seal of the frangible closure 16 and exits the barrel 12, which to this point in the procedure has been used as a shipping and storage tube for the projectile 13. The guidance system of the projectile 13 causes an internal propulsion system to turn the projectile 13 towards the target. The barrels 12 and recoil systems 15 of the cells 10 where the single projectile has been fired are removed and either disposed of or refurbished and replaced In another method of using the single cell 10, the single cell 10 is shipped to the field where it is used to replace a fired single cell 10 in an already fielded matrix configuration 10. Once again, the barrel 12 is both the shipping container and the launching tube thus ensuring maximum shelf life, and thus maximum ordnance effectiveness of the projectile 13.

In either method outlined above, once the projectile 13 is fired from the barrel 12, the barrel 12 can be discarded or sent back to the ordnance depot for overhaul and reuse.

In another embodiment, the matrix uses a smaller container to house fewer cells, like 10 cells. The matrix is placed on the ground, which supports the matrix in a vertical position or in a position angled from the vertical.

In another embodiment, electromagnetic waves carried through space and receivers connected to the ignition systems 18 replace electrical signals carried through wires 19 as another means for electrically connecting the control system 20 to ignition systems 18.

The advantages of this invention include a virtual unlimited firing rate since no loading mechanism is used. Another major advantage is that the shelf life of the guided rounds can be held to their maximum shelf life, since the only time the container seal is broken is when the munitions is fired. Another subtle yet very important advantage the matrix gun has over conventional guns is the ability for continuous system readiness testing of the individual guided munitions. In a conventional gun with a moving munitions handling system, continuous readiness testing of the guided munitions is virtually impossible, or at the very best a complicated and often manpower intensive operation. The matrix gun system with disposable barrels and recoil systems eliminates complex loading systems and human contact with ordinance, typical of large gun systems. This allows for in a reduction of down time caused by failures in the loading system, human error, or problems with single point of failure gun barrels and recoil systems. The reduction of human contact also increases safety.

While preferred embodiments of the present invention have been shown and described herein, it will be appreciated that various changes and modifications may be made therein without departing from the spirit of the invention as defined by the scope of the appended claims.

What is claimed is:

1. A gun system comprising:

a first cell comprising:

a barrel having a closed first end and a second end and a length extending from the first end to the second end;

a guided projectile located within said barrel;

a propelling charge located within said barrel between said projectile and the first end of said barrel;

an expendable recoil system attached to the first end of said barrel on the side opposite said propelling charge;

a seal sealing the second end of said barrel; and a preservative gas filling the interior of said barrel.

2. The gun system, as claimed in claim 1, further comprising:

a control system; and an ignition system adjacent to the propelling charge and electrically connected to the control system.

3. The gun system, as claimed in claim 2, wherein the seal normally retains the preservative gas within the barrel and prevents the entry of ambient fluids, and is frangible when the projectile is fired to permit its egress from the barrel.

4. A method of operating a gun system having a barrel with a closed lower end and an open upper end comprising the steps of:

placing an expendable recoil system under the closed lower end of said barrel;

placing a propelling charge in said barrel adjacent the closed lower end of said barrel;

placing an ignition system adjacent to the propelling charge;

placing a guided projectile in the barrel between the propelling charge and the open upper end of said barrel;

filling the barrel with a preservative gas;

sealing the upper end of the barrel with a breakable seal;

storing and transporting the projectile in said barrel; and igniting the propellant by activating the ignition system, whereby the forces created by the ignition of the projectile causes the projectile to breaks through the seal and exit the upper end of said barrel and causes recoil forces exerted on the barrel to be absorbed by the recoil system.

5. The method, as claimed in claim 4, wherein the step igniting the propellant, comprises the steps of:

generating an electrical signal from a control system; and transmitting the signal from the control system to the ignition system.

6. The method, as claimed in claim 5, and further comprising the steps discarding the expendable recoil system after the projectile has been fired; and using the same barrel, repeating the steps of claim 5.

* * * * *